United States Patent [19]

Oberleitner

[11] Patent Number: 4,482,168

[45] Date of Patent: Nov. 13, 1984

[54] SAFETY SKI BINDING

[75] Inventor: Gerhard Oberleitner, Vienna, Austria

[73] Assignee: TMC Corporation, Baar, Switzerland

[21] Appl. No.: 355,290

[22] Filed: Mar. 8, 1982

[30] Foreign Application Priority Data

Mar. 10, 1981 [AT] Austria ..... 1110/81

[51] Int. Cl.[3] ..... A63C 9/08

[52] U.S. Cl. ..... 280/612; 200/61.52

[58] Field of Search ..... 280/612, 613, 611; 320/13, 21, 31, 37, 38, 54; 307/10 LS; 200/153 K, 153 M, 51.09, 61.52

[56] References Cited

U.S. PATENT DOCUMENTS

| | | | |
|---|---|---|---|
| 1,717,467 | 6/1929 | Schleich | 200/51.09 |
| 1,742,685 | 1/1930 | Brandon | 200/61.02 |
| 3,073,922 | 1/1963 | Miller | 200/61.02 |
| 3,577,208 | 5/1971 | Petrick | 200/51.09 |
| 3,621,276 | 11/1971 | Mitchell | 320/13 |
| 3,762,735 | 10/1973 | Smolka | 280/11.35 |
| 3,907,316 | 9/1975 | Marker et al. | 280/11.35 |
| 3,997,831 | 12/1976 | Hopfner | 320/13 |
| 4,140,331 | 2/1979 | Salomon | 280/612 |
| 4,146,829 | 3/1979 | Rinaldi | 320/13 |
| 4,156,534 | 5/1979 | Salomon | 280/612 |
| 4,385,258 | 5/1983 | Voll | 307/10 LS |

*Primary Examiner*—Joseph F. Peters, Jr.
*Assistant Examiner*—Michael Mar
*Attorney, Agent, or Firm*—Flynn, Thiel, Boutell & Tanis

[57] ABSTRACT

In safety ski bindings with electronic evaluation and release circuits, which can be supplied from a voltage source through a switching device and which activate, in case of risk of injury, a release mechanism for the release of a ski boot held in the binding, there exists the problem that the control circuit is supplied with voltage even when the skier stands still with attached skis or travels on a chairlift, which results in an unnecessary current consumption. To solve this problem, a selectively activatable acceleration responsive device is provided in the switching device, which acceleration responsive device is connected to an electronic switching element through a time circuit and, if desired, through a threshold switch.

15 Claims, 7 Drawing Figures

SAFETY SKI BINDING

FIELD OF THE INVENTION

The invention relates to a safety ski binding with electronic evaluation and release circuits, which process the signals which come from load sensing means and in the case of danger, activate a release mechanism to release the ski boot which is held in the binding, and which can be fed from a voltage source through a switching device.

BACKGROUND OF THE INVENTION

Such a safety ski binding has become known, for example, through German Offenlegungsschrift No. 27 05 174 (which corresponds to U.S. Pat. No. 4,140,331). In this known solution, the switching device is operated during a stepping into the binding and closes the supply circuit to effect an electrical supply to the control circuit, which in the case of danger, controls the release of the binding. With this, it is achieved that the control circuit is under voltage only when indeed a ski boot is held by the binding. Thus, the control circuit is constantly under the influence of the voltage and the current source, primarily a battery, that is, the battery is constantly under a load, even though little, due to the unavoidable leakage current.

Studies have shown that for most skiers the amount of time, during which they stand with their skis on or during which risk of injury and for which the need for a release will not occur, for example, during travel on a chairlift, is relatively high. However, the control circuit in the known solution is fed by the current source during such times, which results in an unnecessary consumption of battery power.

It is the goal of the invention to provide a safety ski binding wherein the consumption of battery power is reduced to a minimum level.

SUMMARY OF THE INVENTION

This purpose is inventively achieved by the provision of a switching device having a selectively activatable acceleration responsive device connected to an electronic switching element through a time circuit and, if desired, a threshold switch. This assures that the evaluation and release circuit of the binding are supplied with voltage only when acceleration forces act onto the ski or the binding, which forces indicate that the skis are indeed in a skiing condition and, therefore, dangerous situations which necessitate a release of the binding can occur. During a mere standing still, for example, during travel on a chairlift, however, the current supply to the release circuit and to the evaluation circuit remains in an interrupted state.

In order to assure a current supply to the release circuit and to the evaluation circuit under all circumstances also during the transport of the skis, according to a further characteristic of the invention it is provided that the acceleration responsive device is formed by a first contact piece secured to the free end of an electrically conductive bar spring which is clamped at the other end, and an opposing second contact piece, which surrounds the first contact piece, and that the first contact piece and the opposing second contact piece are movable against one another in axial direction between two positions, wherein in one of the positions, the second contact piece lies outside of the region of movement of the first contact piece and one of the contacts is held on a ski-fixed part of a common thrust-balancing device or is connected to such part and the other one is held on a part of a common thrust-balancing device, which part is movable relative to the first-mentioned part, or is connected to such part. This construction results in the advantage of being able to provide a simple design for the acceleration responsive means.

A further very advantageous embodiment of an acceleration responsive device is distinguished by the acceleration responsive device being formed by a first contact piece which is secured on the free end of an electrically conductive bar spring, which is clamped at one end, and a second contact which surrounds the first contact piece, and by providing an insulator which can be moved into the annular gap between the first contact piece and the second contact piece, wherein the contacts are advantageously held on a ski-fixed part, whereas the insulator is held on a part of a common thrust-balancing device, which part is movable with respect to said insulator.

A further advantageous embodiment consists in the acceleration responsive device being formed by a first contact piece secured on the free end of an electrically conductive bar spring clamped at one end, and an opposing second contact which surrounds the first contact piece, and by a switch, which is only closed when the ski boot is fixed in the binding, being interpositioned between one of the contacts and the current source. Therefore, this arrangement also assures that during a transport of the skis the current supply to the release and the evaluation circuits is interrupted.

According to a further characteristic of the invention, it is provided that the time circuit is formed by a series connected RC-network, wherein the acceleration responsive device is constructed as a switch and is connected in parallel with the capacitor of the RC-network and wherein the electronic switching element connected to the capacitor conducts at a voltage below a defined value and appearing on the capacitor. Through these measures, it is achieved that when accelerative forces occur, which result in a—even though for a short period of time—closing of the contacts of the acceleration responsive device, the release and the evaluation circuit are immediately activated or supplied with current and start to work and, if a further activation does not occur until the time circuit runs out, the supply is disconnected. Since the through-connection of the electronic switching element upon the occurrence of a sufficiently large acceleration impulse, which leads to the closing of the contacts of the acceleration responsive device, occurs practically without delay, it is also possible to set the switching threshold for the acceleration responsive device and thus the switching-on threshold for the evaluation and the release circuits relatively high, so that these circuits are activated only upon the occurrence of accelerative forces, as they occur in situations, which come close to the release conditions of the binding, however, still clearly in relationship to the intensity of the impulse lie therebelow. In this manner, it is possible to reduce the switching-on duration of the evaluation and of the release circuit or the time of the operation readiness of said circuit to a minimum and with this it is possible to extend the life of the battery which is provided for the voltage supply.

BRIEF DESCRIPTION OF THE DRAWINGS

The invention will now be discussed in greater detail with reference to the drawings, which illustrate several exemplary embodiments.

In the drawings.

DETAILED DESCRIPTION

Figure 1:
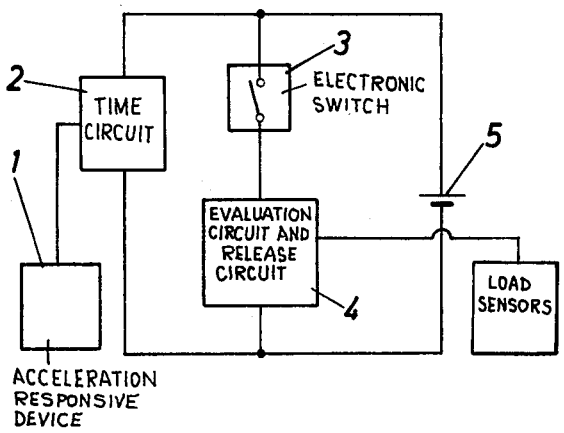
FIG. 1 illustrates a block diagram of an inventive binding.

As can be seen from FIG. 1, the acceleration responsive device 1 is connected to a time circuit 2, which is activated upon the occurrence of a suitable acceleration force. The response threshold can thereby be determined already through the design of the acceleration responsive device 1, for example if same is constructed as an acceleration switch 10, or, and on the other hand, a threshold switch, for example a Schmitt-trigger, can be connected between the time circuit 2 and an electronic switch 3. The time circuit remains in an active condition corresponding with its time constant after each activation for a pregiven time by controlling the aforementioned after-connected electronic switch 3 in the sense of a closed circuit. Thus, during this time span, the electronic unit 4 is connected to the voltage source 5 and is thus ready to operate. The electronic unit 4 includes both an evaluation circuit, which processes signals of power receiving means (not illustrated), and also a release circuit, which is controlled by same and effects a release of the binding in the case of danger to cause a release of the ski boot from the binding. The evaluation circuit of the electronic unit could be constructed, for example, according to U.S. application Ser. No. 315,671, filed Oct. 27, 1981 and the release circuit according to an electromagnetic valve disclosed therein, and reference thereto is to be incorporated herein.

The acceleration responsive device 1, the time circuit 2 and the electronic switch 3 assure that the electronic unit 4 is connected to the voltage source 5 only during a time span during which the ski, which is provided with such a binding, is moving.

Figure 2:
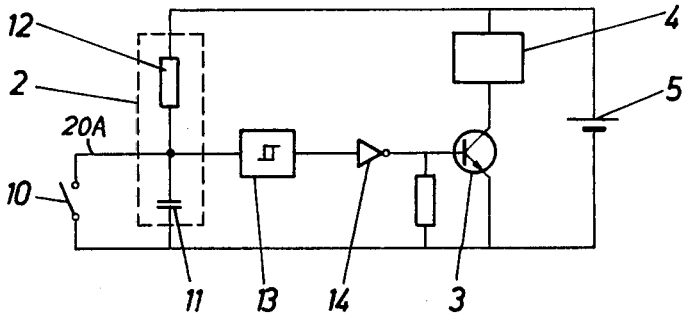
FIG. 2 illustrates an exemplary embodiment of the invention having an acceleration switch functioning as an acceleration responsive device.

In the embodiment according to FIG. 2, the acceleration responsive means is constructed as an acceleration switch 10 which closes upon reaching a certain magnitude of acceleration and which is connected in parallel to a capacitor 11 of an RC-network functioning as the time circuit 2 and which consists of a resistor 12 and the aforementioned capacitor 11. If the acceleration switch 10 closes, then the capacitor 11 discharges and the Schmitt-trigger 13, the input control to which is connected intermediate the connecting point between the resistor 12 and the capacitor 11, changes its state of conduction. This causes the voltage level at the output of an inverter 14 to jump to a sufficiently high value and the electronic switch 3, which is a transistor, conducts, so that the electronic unit 4 is supplied with current.

If the acceleration switch 10 opens again, then the capacitor 11 is again charged through the resistor 12. When the voltage attains a certain value on the capacitor 11, then the conducting state of the Schmitt-trigger 13 changes again to its initial state, which causes the output voltage of the inverter to suddenly drop to zero and the electronic switch 3 to open.

Basically it would be possible to do without the Schmitt-trigger 13 and, if desired, also without the inverter, however, a maintaining of a switching threshold would then only be possible within a relatively large voltage variation.

Figure 3:
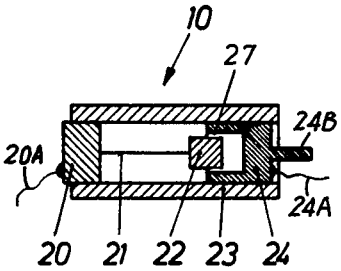
FIGS. 3 to 5 schematically illustrate, respectively, various embodiments of acceleration switch arrangements.
Figure 4:
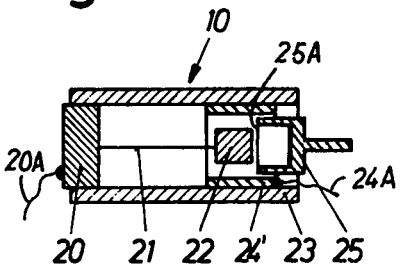
Figure 5:
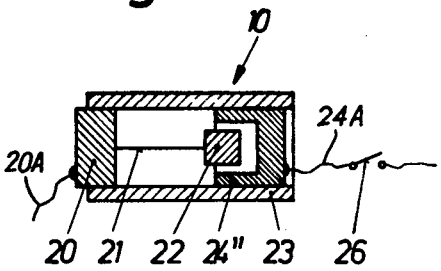

FIGS. 3 to 5 illustrate schematical embodiments of acceleration-switch arrangements, in which it is assured that a reaction of the acceleration switch 10 during a mere transport of the binding or skis, thus without a ski boot therein, remains but without effect, that is, it does not result in a connection through to the control electrode of the electronic switch 3.

Each of the acceleration switches 10 consist substantially of a connecting piece 20 made of a conducting material, to which is connected an electrically conductive line 20A which extends, for example, to the battery 5 or to the connecting point between the resistor 12 with the capacitor 11. A bar spring 21, for example a piece of spring wire, is anchored to the piece or end wall 20 and has fixedly secured on its free end a contact piece 22. This contact piece 22 simultaneously serves as a pendulum of the acceleration switch. Furthermore, the acceleration switch 10 has an insulated sleeve 23 which is secured to the connecting piece 20, in which insulated sleeve is held on opposing contact piece 24 which surrounds the contact piece 22 with a clearance space 27 therebetween. An electrically conductive line 24A is connected to the contact piece 24.

Figure 6:
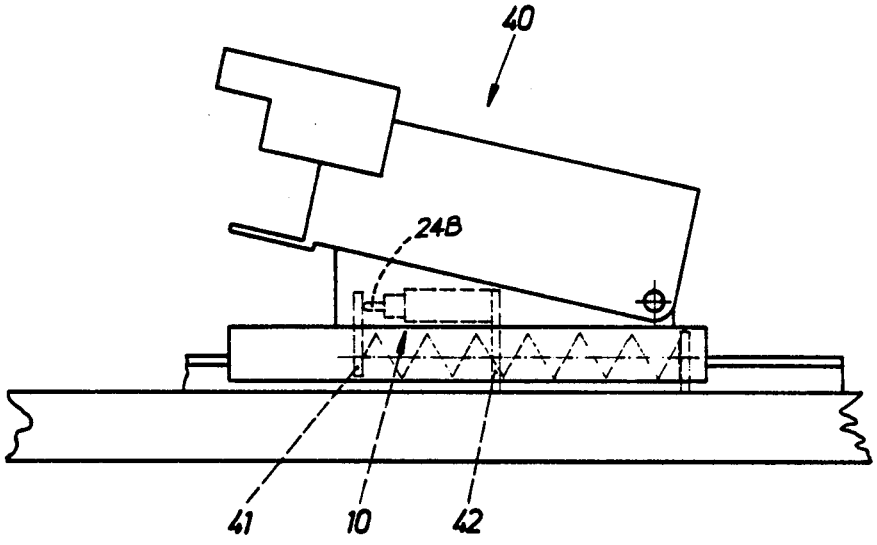
FIGS. 6 and 7 schematically illustrate the arrangement of an acceleration switch on a part of the binding.
Figure 7:
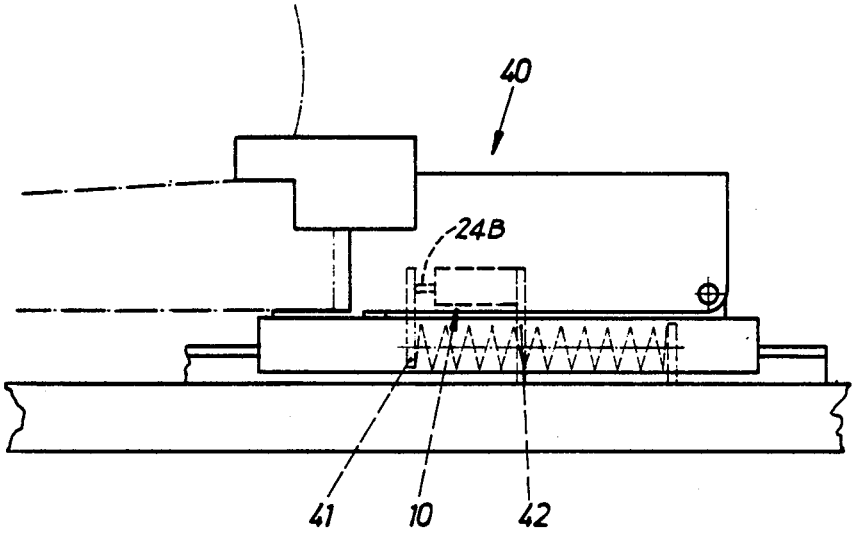

In the embodiment according to FIG. 3, the contact piece 24 is supported for movement in an axial direction in the insulated sleeve 23. A projection 24B on the contact piece 24 is positioned to engage, as can be seen from FIGS. 6 and 7, a shoulder 41 connected to a jaw 40 which has a thrust-balancing device thereon, which engagement is through an insulative cap or the like on the projection 24B. The remaining part of the acceleration switch 10 is secured to a ski-fixed holding part 42. It is thus achieved that a contact between the contact piece 22 and the contact piece 24 can only occur when the shoulder 41 of the jaw 40 has come sufficiently close to the ski-fixed holding part 42. This, however, only occurs when a ski boot 43 is held in the binding. As a result, during a mere transport of the skis which are provided with such a binding, a contact between the contact pieces 22 and 24 in the acceleration switch 10 and thus a through-connection to the electronic switch 3 cannot occur.

This is also the case in the embodiment according to FIG. 4. The opposing contact piece 24' is fixedly secured in the insulating sleeve 23 and is always in the region of movement of the contact piece 22. To prevent a contact between the contact pieces 22 and 24' from occurring during the mere transport of the skis, an insulator 25 is provided with an annular, axially projecting edge 25A or at least three equidistantly spaced, axially projecting shoulders. The insulator 25 is axially movably supported on the contact piece 24', whereby the annular projection or edge 25A can be moved into the annular gap between the contact piece 22 and the contact piece 24' and can again be moved therefrom. In addition, the insulator 25 is preferably secured to a part which is connected to the jaw 40 and moves therewith, whereas the insulated sleeve on the acceleration switch is secured to a ski-fixed holding part. Of course, this fastening must be accomplished in such a manner that the distance between these parts increases during a stepping into the binding.

In the embodiment of the acceleration switch 10 according to FIG. 5, the connecting piece 20 and the opposing contact piece 24" are also rigidly arranged in the insulated sleeve 23, however, a switch 26 is provided in the electrically conductive line to the contact piece 24", which switch is operated during a stepping into the binding, or which closes as soon as the ski boot is fixed or anchored in the binding, or as soon as the ski boot has come sufficiently close to its fixed or anchored position in the binding.

Thus it is also assured in this arrangement that acceleration forces which occur, for example, during the transport of the skis do not result in a through-connection of the electronic switch 3.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A safety ski binding adapted to be mounted on a ski, comprising: electrically actuated release means for releasably holding a ski boot on the ski; sensor means for producing electrical signals in response to forces acting on a ski boot releasably held by said release means; control circuit means operatively coupled to said release means and said sensor means and adapted to evaluate said signals from said sensor means for selectively causing said release means to release a ski boot held therein if said signals from said sensor means indicate forces in excess of a predetermined value are acting on the ski boot; an electrical power source; acceleration responsive means which produces an output signal when an acceleration force in excess of a predetermined value acts on said binding; and time circuit means responsive to said acceleration responsive means for supplying electrical operating power from said power source to said control circuit means for a predetermined interval of time in response to said output signal from said acceleration responsive means and for automatically interrupting the supply of electrical power from said power source to said control circuit means at the end of said predetermined interval of time, wherein electrical power is supplied by said time circuit means to said control circuit means only for said predetermined interval of time in response to each said output signal from said acceleration responsive means.

2. The binding according to claim 1, wherein said acceleration responsive means includes an acceleration switch having first and second contacts which are supported for movement relative to each other, are normally open, and move into engagement with each other when an acceleration force in excess of a predetermined value acts on said acceleration switch.

3. The binding according to claim 2, wherein said time circuit means includes an electronic switch having a control input, said power source, said electronic switch and said control circuit means being connected in series with each other; wherein said time circuit means includes a resistor and a capacitor which each have one terminal connected to a respective terminal of said power source, the other terminals of said resistor and capacitor being connected to each other and said acceleration switch being connected in parallel with said capacitor; and wherein said time circuit means includes Schmitt-trigger means connecting said other terminal of said capacitor to said control input of said electronic switch.

4. The binding according to claim 2, wherein said acceleration switch includes an elongate, electrically conductive spring element having one end which is fixedly supported on said binding and having said first contact supported on the other end thereof, wherein said second contact is annular and encircles said first contact approximately coaxially with respect to said spring element, and wherein an acceleration force causes said first contact to flex said spring element and move into engagement with said second contact.

5. The binding according to claim 4, including disabling means for selectively disabling said acceleration switch except when a ski boot is releasably held in said release means.

6. The binding according to claim 5, wherein said disabling means includes a disabling switch which is connected in series with said acceleration switch and which is actuated by a ski boot releasably held in said binding.

7. The binding according to claim 5, wherein said disabling means includes said second contact being supported for movement in an axial direction generally parallel to said spring element between a first position axially aligned with said first contact and a second position axially spaced from said first contact, and includes means responsive to insertion and removal of a ski boot from said release means for effecting movement of said second contact relative to said first contact between said first and second positions, respectively.

8. The binding according to claim 7, wherein said binding includes a first binding part which is adapted to be secured to the ski, a second binding part which is supported on the first binding part for movement longitudinally of the ski and has said release means thereon, and resilient means yieldably urging movement of said second binding part in one direction relative to said first binding part; wherein said spring element extends approximately longitudinally of the ski and has said one end fixedly supported on one of said binding parts; and wherein said second contact is cooperable with the other of said binding parts, movement of said second binding part relative to said first binding part against the urging of said resilient means during insertion of a ski boot into said binding causing said second contact to move from its second position to its first position relative to said first contact.

9. The binding according to claim 5, wherein said disabling means includes an annular insulator which is supported for movement approximately parallel to said spring element between a first position in which it encircles said first contact and is disposed between said first and second contacts and a second position in which it is spaced axially from said first contact, and includes means responsive to insertion and removal of a ski boot from said release means for effecting movement of said insulator relative to said contacts between its second and first positions, respectively.

10. The binding according to claim 9, wherein said binding includes a first binding part adapted to be secured to the ski, a second binding part supported on said first binding part for movement approximately longitudinally of the ski and having said release means thereon, and resilient means yieldably urging said second binding part in one direction; wherein said spring element extends approximately longitudinally of the ski and has said one end fixedly supported on one of said binding parts; and wherein the other of said binding parts is cooperable with said insulator, movement of said second binding part relative to said first binding part against the urging of said resilient means during insertion of a ski boot into said binding causing said insulator to move relative to said contacts from said first position to said second position.

11. The binding according to claim 6, claim 7 or claim 9, wherein said acceleration switch includes a cylindrical sleeve having an end wall at one end thereof, said spring element having said one end thereof fixedly supported on said end wall and said spring element extending approximately coaxially within said sleeve, and wherein said second contact is supported on an inner surface of said sleeve.

12. A safety ski binding, comprising electrically actuated release means for releasably holding a ski boot on a ski, sensing means for measuring forces acting on a ski boot held by said release means, electronic evaluation and release circuit means for processing signals from said sensing means and, in case of danger, for activating said release means to cause said release means to release a ski boot held therein, switching means, and a power source which supplies electrical power to said evaluation and release circuit means through said switching means; wherein said switching means includes selectively activatable acceleration responsive means, time circuit means responsive to said acceleration responsive means for producing an output signal for at least a first predetermined interval of time each time said acceleration responsive means detects an acceleration force, and an electronic switching element which is controlled by said output signal from said time circuit means and supplies power from said power source to said evaluation and release circuit means in response to said output signal; wherein said acceleration responsive means includes a first contact piece which is secured to a free end of an elongate, electrically conductive bar spring which is fixedly supported at its other end, and includes an opposing second contact piece which surrounds said first contact piece; wherein said first contact piece and said second contact piece are movable relative to one another in a direction approximately parallel to said bar spring between two positions; wherein in one of said positions said second contact piece is spaced from the region of movement of said first contact piece; and wherein one of said first and second contact pieces is supported on a first part of a thrust-balancing device which can be secured to the ski and the other of said contact pieces is supported on a second part of said thrust-balancing device which is movable with respect to said first part thereof.

13. A safety ski binding, comprising electrically actuated release means for releasably holding a ski boot on a ski, sensing means for measuring forces acting on a ski boot held by said release means, electronic evaluation and release circuit means for processing signals from said sensing means and, in case of danger, for activating said release means to cause said release means to release a ski boot held therein, switching means, and a power source which supplies electrical power to said evaluation and release circuit means through said switching means; wherein said switching means includes selectively activatable acceleration responsive means, time circuit means responsive to said acceleration responsive means for producing an output signal for at least a first predetermined interval of time each time said acceleration responsive means detects an acceleration force, and an electronic switching element which is controlled by said output signal from said time circuit means and supplies power from said power source to said evaluation and release circuit means in response to said output signal; wherein said acceleration responsive means includes a first contact piece which is secured to a free end of an elongate, electrically conductive bar spring which is fixedly supported at its other end, and includes a second contact piece which surrounds said first contact piece; wherein an annular insulator is provided which is movable into an annular space provided between said first contact piece and said second contact piece; and wherein said first and second contact pieces are supported on a first part which is fixed against movement relative to the ski and said insulator is supported on a part of a thrust-balancing mechanism which is movable with respect to the ski.

14. A safety ski binding, comprising electrically actuated release means for releasably holding a ski boot on a ski, sensing means for measuring forces acting on a ski boot held by said release means, electronic evaluation and release circuit means for processing signals from said sensing means and, in case of danger, for activating said release means to cause said release means to release a ski boot held therein, switching means, and a power source which supplies electrical power to said evaluation and release circuit means through said switching means; wherein said switching means includes selectively activatable acceleration responsive means, time circuit means responsive to said acceleration responsive means for producing an output signal for at least a first predetermined interval of time each time said acceleration responsive means detects an acceleration force, and an electronic switching element which is controlled by said output signal from said time circuit means and supplies power from said power source to said evaluation and release circuit means in response to said output signal; wherein said acceleration responsive means includes a first contact piece which is secured to a free end of an elongate, electrically conductive bar spring which is fixedly supported at its other end, and includes an opposing second contact piece which surrounds said first contact piece, and wherein one of said contact pieces is connected to said power source through a switch which is only closed when a ski boot is releasably held by said release means.

15. The safety ski binding according to claim 12, claim 13 or claim 14, wherein said time circuit means includes a capacitor and resistor connected in series, wherein said acceleration responsive means is connected in parallel with said capacitor, and wherein said electronic switch element is connected to said capacitor and supplies power from said power source to said evaluation and release circuit means when a voltage appearing on said capacitor is below a predetermined value.

* * * * *